US006722756B2

(12) United States Patent
Choy et al.

(10) Patent No.: US 6,722,756 B2
(45) Date of Patent: Apr. 20, 2004

(54) CAPPING SHROUD FOR FLUID EJECTION DEVICE

(75) Inventors: Si-lam J. Choy, Corvallis, OR (US); John M. Altendorf, Corvallis, OR (US); Carl L. Baker, Corvallis, OR (US); Yi Feng, San Deigo, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 15 days.

(21) Appl. No.: 10/186,489

(22) Filed: Jul. 1, 2002

(65) Prior Publication Data

US 2004/0001117 A1 Jan. 1, 2004

(51) Int. Cl.[7] ..... B41J 2/165
(52) U.S. Cl. ..... 347/29
(58) Field of Search ..... 347/29, 33, 40, 347/49, 50, 58, 71, 20, 47; 439/77

(56) References Cited

U.S. PATENT DOCUMENTS

| | | | | |
|---|---|---|---|---|
| 4,806,106 | A | 2/1989 | Mebane et al. | 439/77 |
| 5,442,384 | A | 8/1995 | Schantz et al. | 347/20 |
| 5,442,386 | A | 8/1995 | Childers et al. | 347/50 |
| 5,903,295 | A | 5/1999 | Swanson et al. | 347/87 |
| 6,322,200 | B1 | 11/2001 | Feinn et al. | 347/58 |
| 6,325,491 | B1 | 12/2001 | Feinn | 347/50 |
| 6,338,550 | B1 * | 1/2002 | Amano et al. | 347/71 |
| 6,361,160 | B2 | 3/2002 | Feinn et al. | 347/87 |
| 2002/0024551 | A1 | 2/2002 | Saito | 347/30 |

* cited by examiner

*Primary Examiner*—Shih-Wen Hsieh

(57) ABSTRACT

A capping shroud for a fluid ejection device is disclosed as one embodiment of the invention. A fluid ejection assembly may include the fluid ejection die and the capping shroud. The capping shroud has an aperture therethrough and surrounds the fluid ejection die. A top surface of the capping shroud is substantially flush with a top surface of the fluid ejection die.

29 Claims, 7 Drawing Sheets

CAPPING SHROUD FOR FLUID EJECTION DEVICE

BACKGROUND OF THE INVENTION

Color printers have become very popular. Previously, such printers were mainly used only for professional purposes, since their cost could run into the thousands of dollars. Professional artists and entities concerned with printing color images and documents on various types of media had at their disposal high-end printers that could generate very life-like color prints. More recently, however, the cost of color printers, including laser printers but more usually inkjet printers, has plummeted, resulting in their purchase by home users and other non-professionals. With the advent of applications like digital photography, such low-cost color printers are increasingly being used to print color prints of photos, computer-drawn images, and other types of documents. Improvements to printers have thus generally focused on increasing the quality of their output, and decreasing their cost.

An inkjet printer is more generically a fluid-ejection device that ejects fluid—the ink—onto media, such as paper. A typical inkjet printer usually has a number of common components, regardless of its brand, speed, and so on. In particular, there is a print head that contains a series of nozzles used to spray droplets of ink onto paper. Ink cartridges, either integrated into the print head or separate therefrom, supply the ink. Most inkjet printers today eject ink by using a drop-on-demand approach, which forces a droplet of ink out of a chamber thermally or mechanically. The thermal method is used by some manufacturers, in which a resistor is heated that forces a droplet of ink out of the nozzle by creating an air bubble in the ink chamber. By comparison, the mechanical approach employed by other manufacturers uses a piezoelectric element that charges crystals that expand and jet the ink onto the media.

A flexible circuit, also known as a "flex circuit," may be used to convey information and electricity from within the printer to the print head, and more particularly to an ejection die that is responsible for ejecting the ink onto the media. The ejection die thus learns by way of the flexible circuit how it should eject the ink onto the media, so that the resulting printed media is in accordance with a desired document. Traditionally, the ejection die has been connected on both ends by the flexible circuit, where the circuit typically extends over or around the ejection die.

However, having the ejection die connect on both ends by the flexible circuit, where the circuit extends over or around the ejection die, serves a useful function in that it provides a substantially flat and continuous capping surface. This surface interfaces with an elastomer cap in the printer that is used to provide a humid environment to minimize drying of ink within the nozzles of the ejection die. This capping surface incidentally acts to protect the die, when a wiper wipes ink from the ejection die, as well as in other situations. Therefore, there is a desire for the present invention.

SUMMARY OF THE INVENTION

An embodiment of the invention relates to a capping shroud for a fluid ejection device. A fluid ejection assembly may include the fluid ejection die and the capping shroud. The capping shroud has an aperture therethrough and surrounds the fluid ejection die. A top surface of the capping shroud is substantially flush with a top surface of the fluid ejection die.

BRIEF DESCRIPTION OF THE DRAWINGS

The drawings referenced herein form a part of the specification. Features shown in the drawings are meant as illustrative of only some embodiments of the invention, and not of all embodiments of the invention, unless otherwise explicitly indicated, and implications to the contrary are otherwise not to be made.

FIG. 6A is a perspective view and FIG. 6B is a cut-away perspective view.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. For example, whereas the invention is partially described in relation to an inkjet printer dispensing ink, it is more broadly applicable of any fluid ejection system ejecting fluid. The following detailed description is, therefore, not to be taken in a limiting sense, and the scope of the present invention is defined only by the appended claims.

Overview

Figure 1:
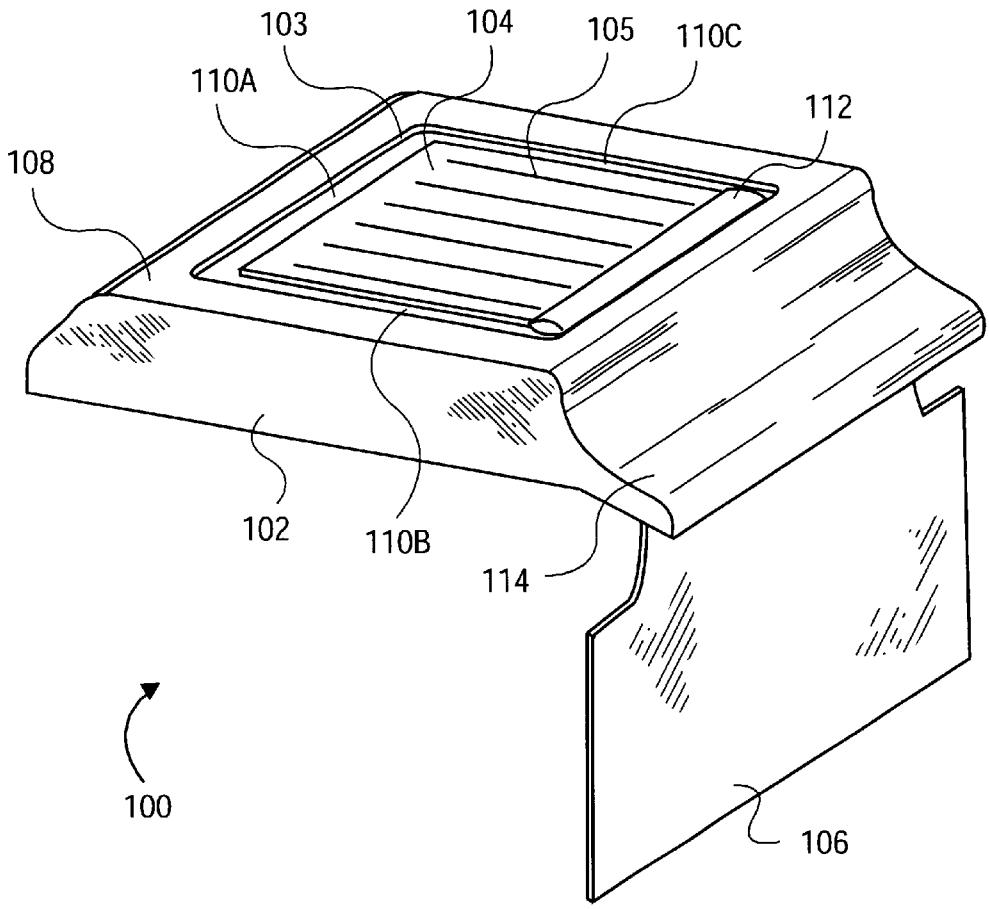
FIG. 1 is a diagram of a perspective view of a capping shroud for a fluid ejection die, according to an embodiment of the invention.

FIG. 1 shows a fluid ejection assembly 100 according to an embodiment of the invention. A capping shroud 102 has an aperture 103 therethrough so that the shroud 102 surrounds a fluid ejection die 104. In the embodiment shown, the aperture 103 is substantially rectangular, and at least as wide and long as the die 104. The capping shroud 102 may be fabricated from plastic, metal, ceramics, elastomers, or another material, and is desirably impermeable to moisture. The fluid ejection die 104 can be an inkjet printer die, such as an inkjet printhead, from which fluid, such as ink for application onto media, is ejected. The term fluid ejection die is used in a general sense, and encompasses fluid ejection plates, fluid ejection semiconductor dies, a die carrier that carries multiple dies, as well as other types of fluid ejection devices. The capping shroud 102 has a top surface 108 that is substantially flush with the top surface of the fluid ejection die 104.

In one embodiment, substantially flush means that the height differential between the top surface 108 of the capping shroud 102 and the top surface 105 of the fluid ejection die 104 is no greater than substantially 0.2 millimeters. In one embodiment, the top surface 108 of the shroud 102 being substantially flush with the top surface 105 of the fluid ejection die 104 allows an elastomeric wiper, not shown in FIG. 1, to substantially wipe clean both the surface of the die 104 and the surface 108 of the shroud 102 at the same time. The capping shroud 102 in one embodiment can be considered the means for providing a capping surface for the fluid ejection die 104 in a flush and circumscribed manner.

The capping shroud 102 preferably is not immediately adjacent to the fluid ejection die 104, such that the ejection die 104 and the capping shroud 102 define a number of trenches, or gaps, channels, or grooves, therebetween. These trenches include the three trenches 110A, 110B, and 110C particularly called out in FIG. 1. A fourth trench is covered by a topside encapsulant 112 that encapsulates electrical couplers of the die 104 and a flexible circuit 106. The trenches are generally referred to as the trenches 110, which collectively include the three trenches 110A, 110B, and 110C, as well as the fourth trench covered by the encapsulant 112. In one embodiment, the trenches are between 500 and 1,000 micrometers ($\mu$m) in width, and have a height of between 600 and 700 $\mu$m.

In one embodiment, a sealant, not particularly shown in FIG. 1, is located between the die 104 and the shroud 102, and is at least substantially near the trenches 110A, 110B, and 110C, such as by at least partially filling these trenches. In one embodiment, this provides a humidity seal between the shroud 102 and the die 104, as will be described in detail later in the detailed description. Furthermore, in one embodiment of the invention, the sealant still renders the top surface 108 of the shroud 102 substantially flush with the top surface 105 of the fluid ejection die 104. That is, in one embodiment the sealant, the top surface 108 of the shroud 102, and the top surface of the fluid ejection die 104, are all substantially flush with one another.

The flexible circuit 106 is electrically coupled to the end of the fluid ejection die 104 nearest to which the encapsulant 112 is located. The flexible circuit 106 allows for communication with the fluid ejection die 104, and specifically includes leads, not particularly shown in FIG. 1, that are coupled to the ejection die 104. These leads are encapsulated by the topside encapsulant 112, to protect them from the fluid that the ejection die 104 ejects. The topside encapsulant 112 in one embodiment can be considered the means for topside-ncapsulating the leads of the flexible circuit 106.

The capping shroud 102 has four sides adjacent to the four trenches, where the sides have a height extending downward from the top surface 108. On the side of the shroud adjacent to the encapsulant 112 is shielding portion 114 The shielding portion 114 protects, or shields, the flexible circuit 106 from fluid. The shielding portion 114 extends outward, and can extend downward by six millimeters (mm) in one embodiment.

Capping Shroud Mounting with an Adhesive Separate from Humidity Sealant

Figure 2A:
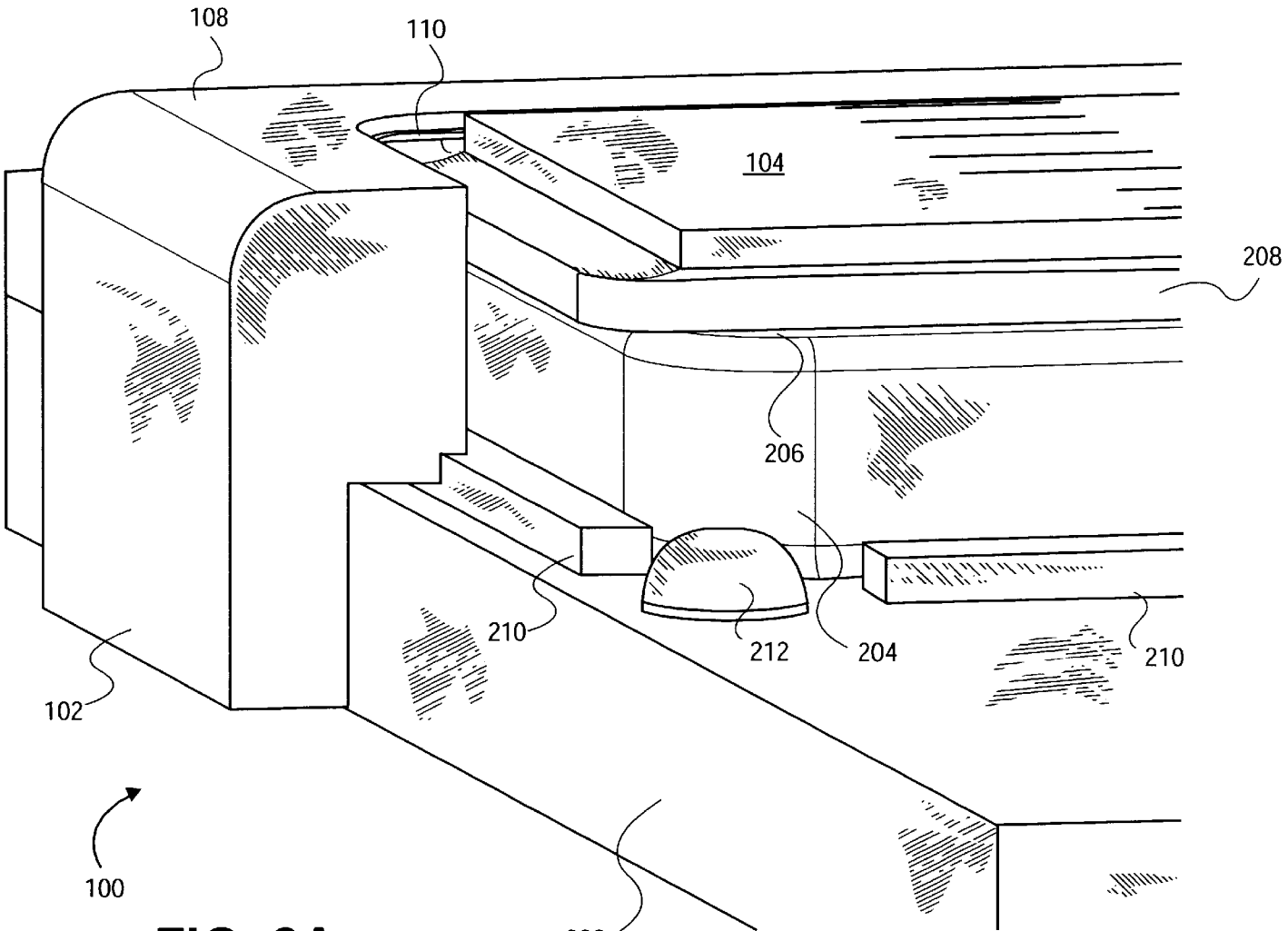
FIG. 2A is a diagram of a cut-away perspective view of a portion of a capping shroud for a fluid ejection die without an inner lip, according to an embodiment of the invention.
Figure 2B:
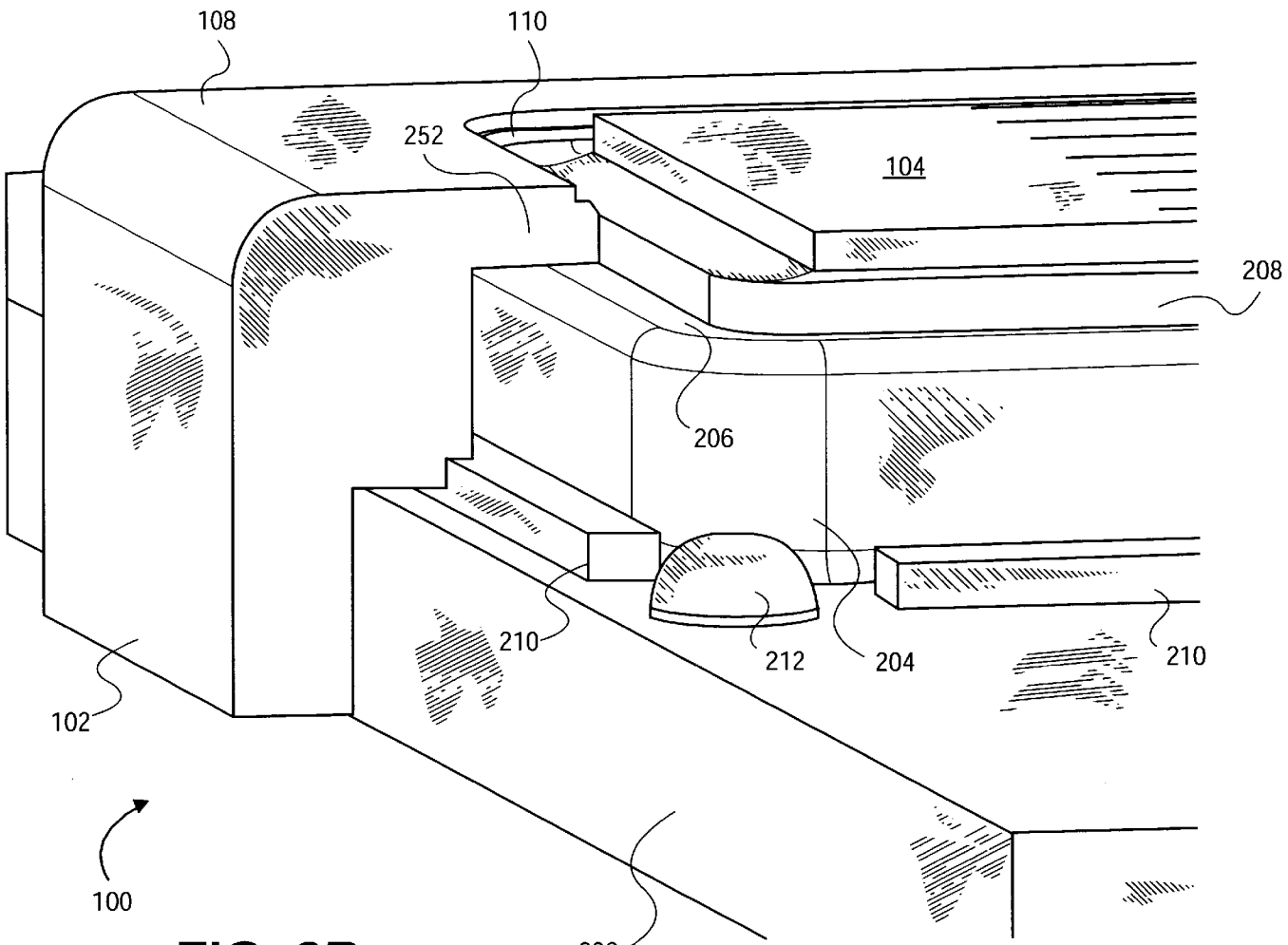
FIG. 2B is a diagram of a cut-away perspective view of a portion of a capping shroud for a fluid ejection die with an inner lip, according to an embodiment of the invention.

FIGS. 2A and 2B show the fluid ejection assembly 100 according to two embodiments of the invention in which the capping shroud 102 is mounted to a die device 202 with an adhesive 210 that is separate from a sealant 208 providing a humidity seal between the shroud 102 and the fluid ejection die 104. The die device 202 may be a die carrier in one embodiment. The embodiments depicted in FIGS. 2A and 2B are initially described as to their common features, and then their differences are described. The die device 202 may be an inkjet cartridge, or another type of carrier for the die 104. Preferably, the die device 202 includes a portion 204 that protrudes therefrom to provide a surface 206 on which the fluid ejection die 104 is mounted. The portion 204 may be referred to as a headland.

In one embodiment, the capping shroud 102 is mounted to the die device 202 primarily via adhesive 210 that is substantially adjacent to sidewalls of the portion 204 of the die device 202. The adhesive 210 may be continuously or discontinuously applied between the portion 204 and the shroud 102. Because the adhesive 210 may require curing to provide optimal adhesion, preferably initial adhesive beads, such as the bead 212, are also placed between the portion 204 and the shroud 102. These adhesive beads provide initial securing of the capping shroud 102 to the die device 202 before the adhesive 210 is completely cured, so that the capping shroud 102 does not substantially move after being placed on the die device 202. The adhesive beads preferably have a different chemical composition than the adhesive 210, and provide stronger initial adhesion than the adhesive 210.

In the embodiments of FIGS. 2A and 2B, a sealant 208 is placed within at least some of the trenches 110 to provide a humidity seal between the capping shroud 102 and the fluid ejection die 104. The sealant 108 is deposited over the surface 206 in between the edges of the die 104 and the inner edges of the aperture 103 of the shroud 102. The humidity seal substantially ensures that the humid environment, provided by a printer cap (not shown in FIGS. 2A and 2B) sealed against the capping shroud 102, remains relatively stable so that nozzles of the ejection die 104 do not dry. In one embodiment, the sealant 208 has a different chemical composition than that of the adhesive 210 and the adhesive bead 212. In the embodiment of FIGS. 2A and 2B, the sealant 208 does not substantially provide adhesion functionality.

Furthermore, preferably the sealant 208 has properties similar to those of rubber, such as the modulus of rubber, to minimize the risk of overly constraining the ejection die 104 to the surface 206. More particularly, the sealant 208 is desirably compliant or flexible. Minimizing the risk of overly constraining the ejection die 104 to the surface 206 minimizes the potential of the die 104 deforming, breaking, and/or cracking. In one embodiment, the sealant 208 can be considered the means for providing a humidity seal between the die 104 and the shroud 102.

The primary difference between the embodiments of FIGS. 2A and 2B is now described. The capping shroud 102 in FIG. 2B has an inner lip 252 along the inside edges of the aperture 103. In one embodiment, the underside of the inner lip 252 substantially rests against, or is otherwise positioned over, the top surface 206 of the portion 204. By comparison, the capping shroud 102 in FIG. 2A does not have this inner lip 252. In FIG. 2A, the manufacturing tolerances of the capping shroud 102 are measured primarily from the surface of the die device 202 on which the adhesive 210 is also placed. In FIG. 2B, the manufacturing tolerances of the capping shroud 102 are measured primarily from the top surface 206 of the portion 204.

The embodiment of FIG. 2B may be preferred so that lateral movement of the capping shroud 102 on the die device 202, and/or imprecise tolerances of the capping shroud 102, does not result in a gap between the shroud 102 and the portion 204 within which the sealant 208 can seep. In one embodiment, this is because the inner lip 252 of the capping shroud 102 in the embodiment of FIG. 2B preferably makes contact with the top surface 206 of the portion 204. Lateral movements of the shroud 102 are thus less than the overlap of the lip 252 on the surface 206.

Capping Shroud Mounting with an Adhesive Also Providing a Humidity Seal

Figure 3:
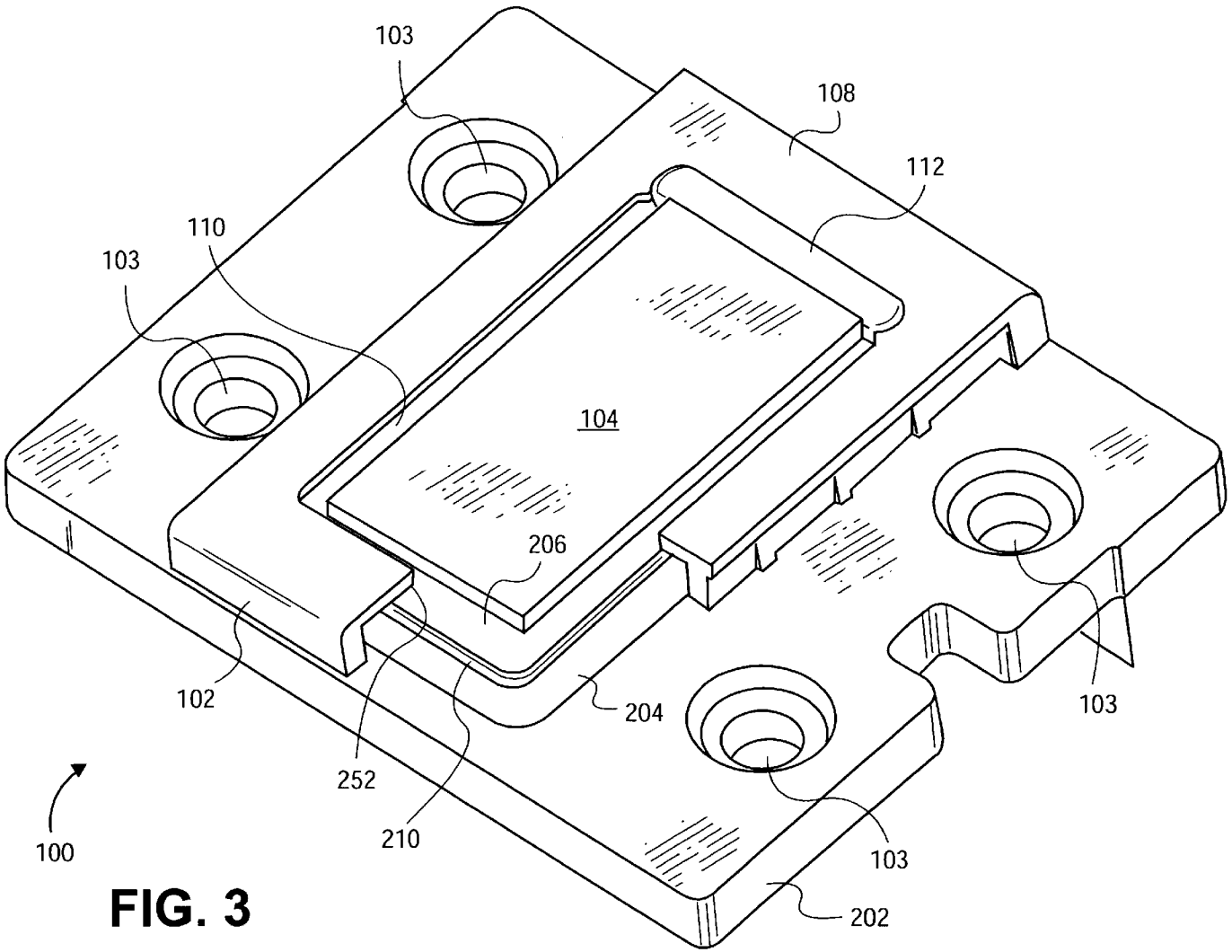
FIG. 3 is a diagram of a cut-away perspective view of a capping shroud for a fluid ejection die, according to an embodiment of the invention.

FIG. 3 shows the fluid ejection assembly 100 according to an embodiment of the invention in which the capping shroud 102 is mounted to the die device 202 with an adhesive 210 that also provides a humidity seal between the shroud 102 and the die device 202. This is in comparison to the embodiments of FIGS. 2A and 2B, in which there is the sealant 208, separate from the adhesive 210, to provide the humidity seal. In the embodiment of FIG. 3, the adhesive 210 provides both adhesion and humidity seal functionality.

The inner lip 252 of the capping shroud 102 thus is secured to the portion 204 of the device 202 by the adhesive 210, and the adhesive 210 also provides the humidity seal between the capping shroud 102 and the die device 202. In this embodiment, the adhesive 210 may also be referred to as a sealant. Furthermore, in one embodiment, the adhesive 210 can be considered the means for providing a humidity seal between the fluid ejection die 104 and the die device 202, and also for securing the capping shroud 102 to the surface 206 of the portion 204 of the die device 202.

Desirably, any portion of the adhesive 210 that is squeezed out from the inner lip 252 substantially does not contact the ejection die 104. The properties of the adhesive 210 that desirably provide a rigid bond between the capping shroud 102 and the die device portion 204 may overly constrain the ejection die 104 to the die device surface 206, if adhesive 210 contacts the die 104. Mounting holes 301 are shown within the die device 202 to mount the device 202 to another device, such as an inkjet cartridge.

Example Fluid Cartridge Assembly and Example Fluid Ejection System

Figure 4A:
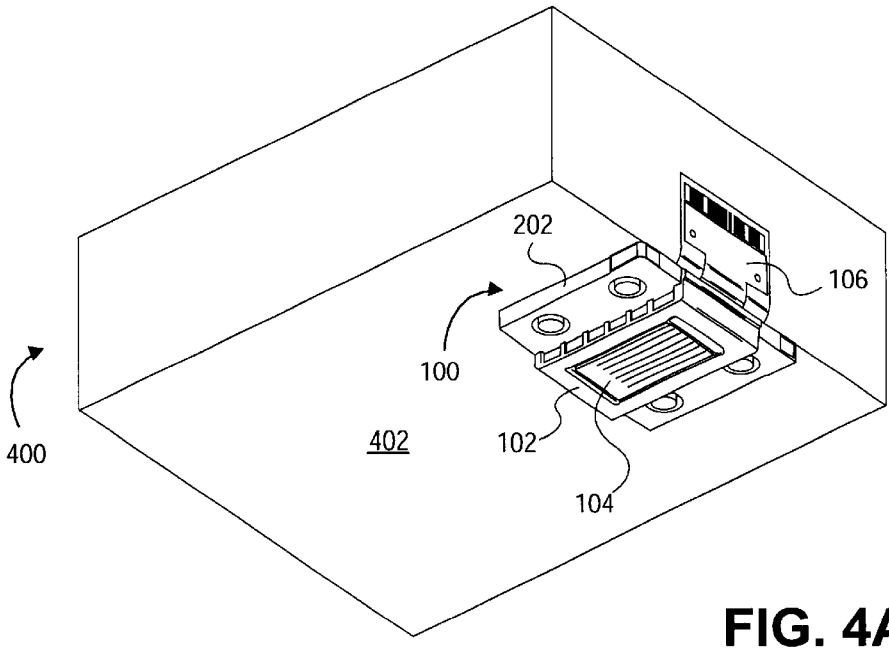
FIG. 4A is a diagram of a perspective view showing as an example the mounting of a capping shroud onto an inkjet ink cartridge, according to an embodiment.
Figure 4B:
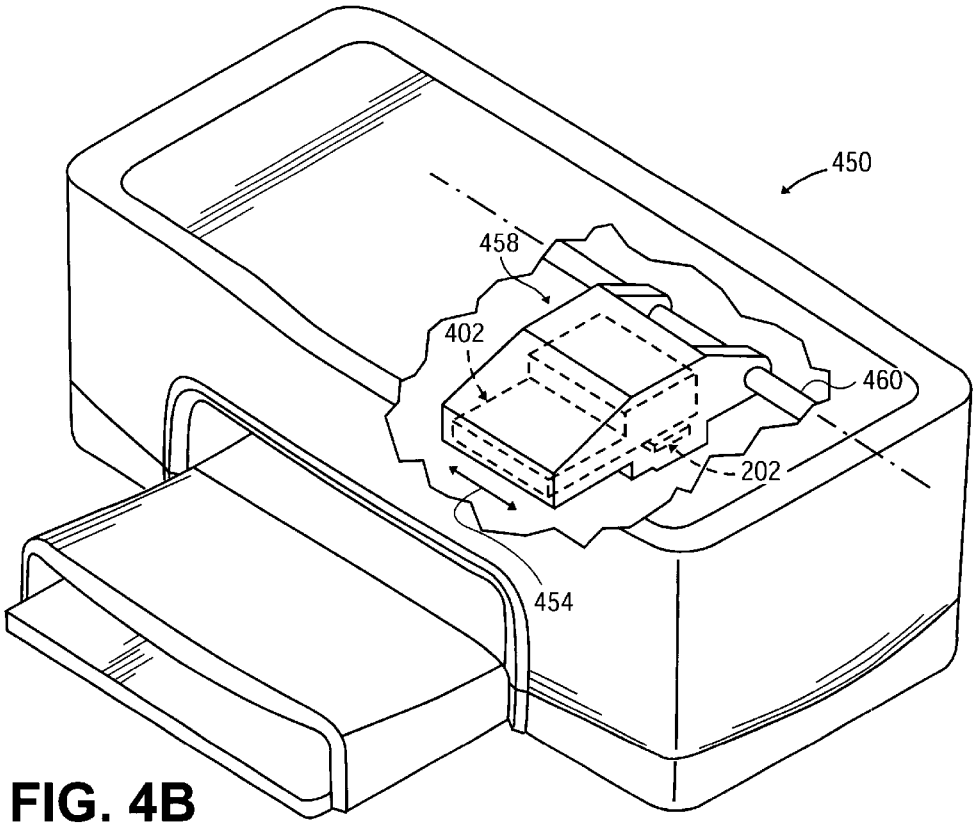
FIG. 4B is a diagram of a cut-away perspective view showing as an example an inkjet printer in accordance with which an embodiment of the invention may be implemented.

FIGS. 4A and 4B show an example fluid cartridge assembly 400 and an example fluid ejection system 450, respectively, in accordance with which at least some embodiments of the invention may be implemented. In FIG. 4A, the fluid cartridge assembly 400 may be an inkjet cartridge assembly. The assembly 400 includes a fluid cartridge 402 that contains fluid and thus is a source of fluid for the die device 202. As before, the capping shroud 102 and the fluid ejection die 104 are mounted on the die device 202. The flexible circuit 106 folds over a side of the cartridge 402 adjacent to the side of the cartridge 402 to which the die device 202 is coupled.

In FIG. 4B, the fluid ejection system 450 is depicted as an inkjet printer for application onto media, such as paper or other media, according to one embodiment of a system of the invention. However, other types of fluid ejection assemblies, besides inkjet printers, are also amenable to embodiments of the invention. A fluid cartridge 402 (e.g., an inkjet cartridge) has mounted thereto the die device 202, such as in accordance with an embodiment of the invention as has been described, and is contained within a carriage 458. The die device 202 preferably has a capping shroud and a fluid ejection die with a flexible circuit coupled thereto, which are not shown in FIG. 4B.

In the embodiment of FIG. 4B, the carriage 458 moves laterally across a rail 460, as indicated by the bidirectional arrow 454, so that ink may be applied to media. As can be appreciated by those of ordinary skill in the art, whereas the example system 450 includes the rail 460, other types of fluid ejection systems, such as other types of inkjet printers, may not use a carriage 458 or a rail. Whereas only one inkjet cartridge is shown in FIG. 4B, a fluid ejection system according to an embodiment of the invention may include more than one such cartridge, having corresponding thereto more than one die carrier, fluid ejection die, flexible circuit, capping shroud, and so on. The different inkjet cartridges may correspond to different colors of ink, for instance, and a given inkjet cartridge may include inks of different colors as well.

Method of Manufacture

Figure 5:
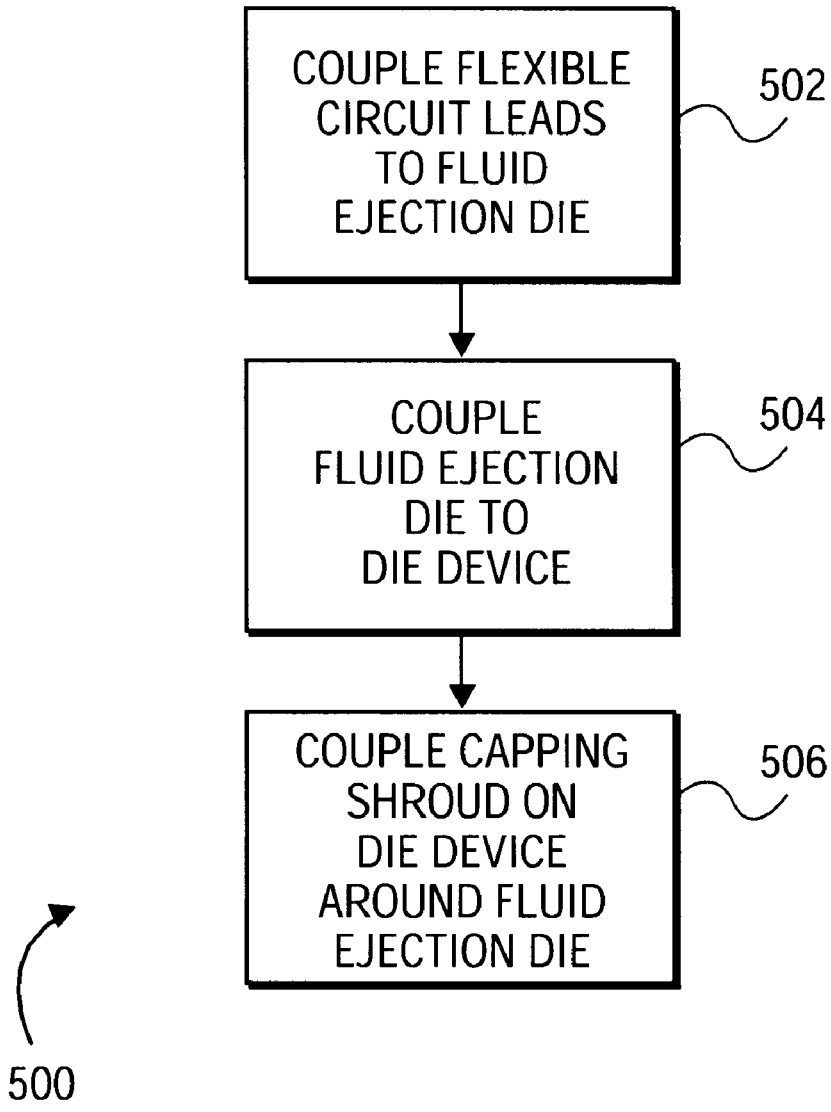
FIG. 5 is a flowchart of a method for assembling and/or mounting a capping shroud, according to an embodiment of the invention.

FIG. 5 shows a method 500 for constructing a fluid ejection assembly for use within a fluid ejection system, according to an embodiment of the invention. First, the leads of a flexible circuit are bonded (viz., coupled, attached, or mounted) to one end of a fluid ejection die (502). The fluid ejection die, with the flexible circuit coupled thereto, is then coupled to a protruding portion of a die device (504). Finally, a capping shroud is coupled on the die device around the fluid ejection die (506).

Figure 6A:
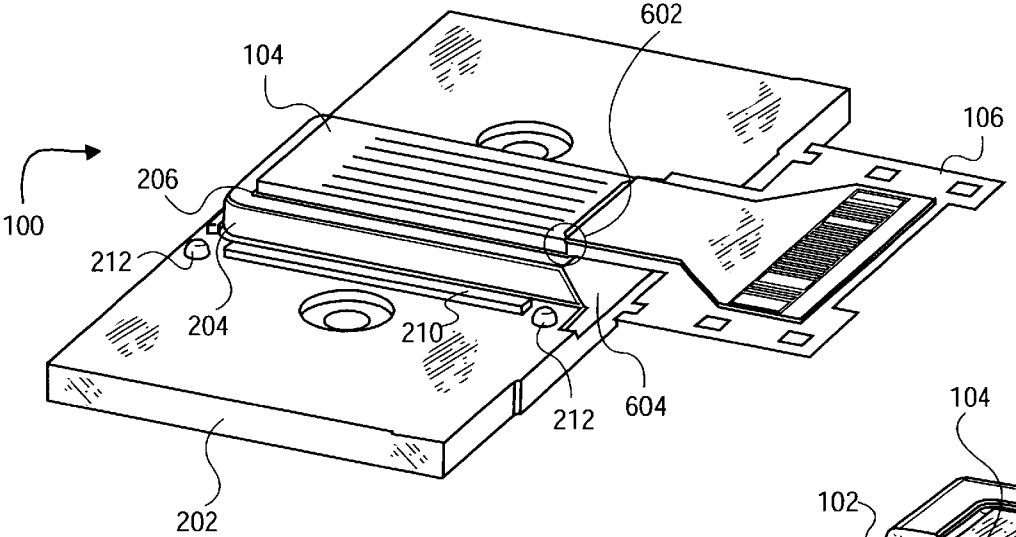
FIGS. 6A and 6B are diagrams illustratively showing the performance of the method of FIG. 5, according to an embodiment of the invention, where
Figure 6B:
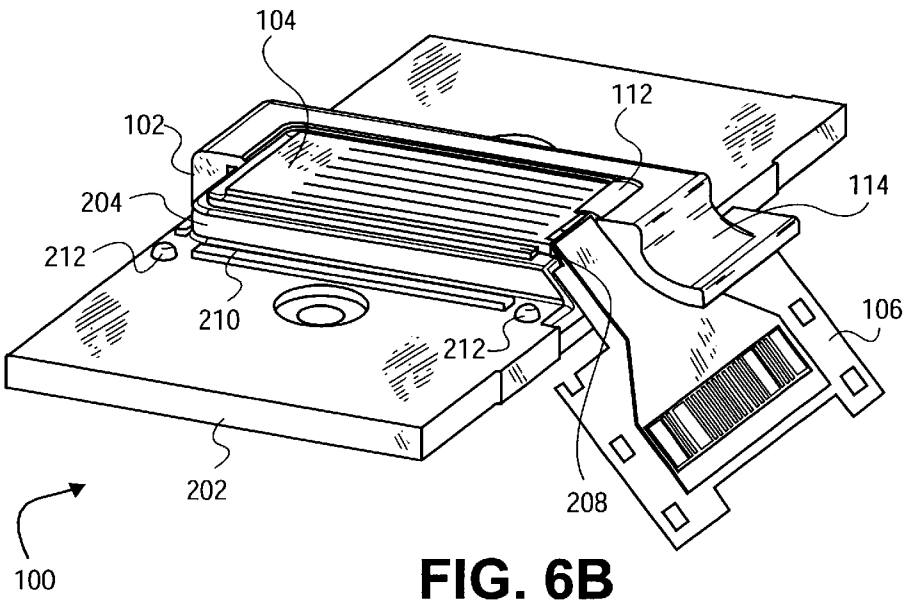

FIGS. 6A and 6B illustratively depicts performance of the method 500 of FIG. 5, according to an embodiment of the invention. In FIG. 6A, the leads of the flexible circuit 106 are coupled to fluid ejection die 104 at the juncture indicated by the circle 602. That is, the end of the flexible circuit 106 indicated by the circle 602 includes the leads that are coupled to the side of the fluid ejection die indicated by the circle 602. Coupling can be accomplished by way of gold-gold thermo-compression bonding (viz., tape-automated bonding), soldering, using anistropic conductive adhesive, and so on, as can be appreciated by those of ordinary skill within the art. The fluid ejection die 104, with the leads of the flexible circuit 106 attached thereto, is then coupled to the die device 202. Such coupling can be accomplished, for example, by using adhesive. The backside encapsulant (not shown) is then dispensed to the leads at the side of the fluid ejection die 104 indicated by the circle 602, to protect the underside of the leads.

In preparation for coupling the capping shroud 102 (not shown in FIG. 6A) to the die device 202, the adhesive 210 is dispensed on the die device 202, and adhesive beads 212 are also dispensed on the die device 202. The embodiment of FIG. 6A is specifically consistent with the embodiments of FIGS. 2A and 2B, and not the embodiment of FIG. 3. That is, the embodiment of FIG. 6A depicts placement of the adhesive 210 on a surface of the die device 202 other than the portion 204, where the adhesive 210 is adjacent to the portion 204. This is consistent with the embodiments of FIGS. 2A and 2B, but is not consistent with the embodiment of FIG. 3, in which the adhesive 210 is instead dispensed on the protruding portion 206.

In FIG. 6B, the capping shroud 102 has been mounted to the die device 202 in a flush and circumscribed manner around the fluid ejection die 104. Upon the mounting of the capping shroud 102, the flexible circuit 106 is bent against a side of the portion 204 of the device 202 indicated as the side 604 in FIG. 6A, but that is now covered by the flexible circuit 106 in FIG. 6B. The backside encapsulant adhering the leads of the flexible circuit 106 to the die 104 preferably seeps along the side 604 of the device 202, between the side 604 and the circuit 106, and thus securing the circuit 106 to the portion 604 of the die device 202. The topside encapsulant 112 is applied over the leads of the flexible circuit 106 from the topside. After coupling the capping shroud 102 to the die device 202, the sealant 208 is dispensed to provide a humidity seal between the fluid ejection die 104 and the capping shroud 102. In this respect, the embodiment of FIG. 6B is again consistent with the embodiments of FIGS. 2A and 2B, but not the embodiment of FIG. 3.

Once the capping shroud 102 has been mounted to the die device 202, and the topside encapsulant 112 has been dispensed over the leads of the flexible circuit 106, the adhesive 210, the backside encapsulant, and the topside encapsulant 112 are preferably simultaneously cured. The backside encapsulant, the topside encapsulant 112, and the adhesive 210 in one embodiment, have an identical chemical formulation. In alternative embodiments of the invention, however, simultaneous curing is not performed, as can be appreciated by those of ordinary skill within the art. For instance, in embodiments of the invention where the sealant 208 is present, such as the embodiments of FIGS. 2A and 2B, the chemical differences between the sealant 208 and the backside encapsulant, the topside encapsulant 112, and the adhesive 210, may result in non-simultaneous curing. However, the sealant 208, the backside encapsulant, the topside encapsulant 112, and the adhesive 210 may also be simultaneously cured as well.

Conclusion

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas the invention is partially described in relation to an inkjet printer dispensing ink, it is more broadly applicable of any fluid ejection system ejecting fluid. Therefore, it is manifestly intended that this invention be limited only by the claims and equivalents thereof.

We claim:

1. A fluid ejection assembly comprising:

a fluid ejection die;

a capping shroud having an aperture therethrough and surrounding the fluid ejection die, a top surface of the capping shroud substantially flush with a top surface of the fluid ejection die; and a sealant between the capping shroud and the fluid ejection die within a trench formed between edges of the die and edges of the aperture, and wherein the sealant at least partially fills the trench between the capping shroud and the fluid ejection die to provide a humidity seal between the capping shroud and the fluid ejection die.

2. The assembly of claim 1, wherein the top surface of the capping shroud is substantially flush with the top surface of the fluid ejection die in that a height difference between the top surface of the capping shroud and the top surface of the fluid ejection die is less than substantially 0.2 millimeters.

3. The assembly of claim 1, further comprising a die device having a protruding portion onto which the fluid ejection die is coupled.

4. The assembly of claim 1, wherein fluid ejected by the fluid ejection die is ink for application onto media.

5. A fluid ejection assembly comprising:

a fluid ejection die;

a capping shroud having an aperture therethrough and surrounding the fluid ejection die, a top the surface of the capping shroud substantially flush with a top surface of the fluid ejection die;

a flexible circuit having leads coupled to an edge of the fluid ejection die; and a topside encapsulant encapsulating the leads of the flexible circuit and at least partially filling a trench between an edge of the aperture and an edge of the fluid ejection die.

6. The assembly of claim 5, wherein the capping shroud has a side that extends downward and that is adjacent to the edge of the fluid ejection die to which the leads of the flexible circuit are couple, the side of the capping shroud shielding the flexible circuit.

7. A fluid ejection assembly comprising:

a fluid ejection die;

a capping shroud having an aperture therethrough and surrounding the fluid ejection die, a top surface of the capping shroud substantially flush with a top surface of the fluid ejection die; and a die device having a protruding portion onto which the fluid ejection die is coupled;

wherein the capping shroud comprises an inner lip having an undersurface positioned at least substantially over the protruding portion.

8. The assembly of claim 7, wherein the undersurface of the inner lip of the capping shroud substantially makes contact with the protruding portion of the die device.

9. The assembly of claim 7, wherein lateral movement of the capping shroud is without substantial effect on a distance of gap between the undersurface of the inner lip of the capping shroud and the protruding portion of the die device.

10. The assembly of claim 7, wherein a sealant couples the inner lip of the capping shroud to the protruding portion of the die device.

11. The assembly of claim 7, wherein the capping shroud is coupled to the die device at the protruding portion.

12. The assembly of claim 7, wherein the capping shroud is mounted to the die device at on a surface thereof other than on the protruding portion.

13. The assembly of claim 12, further comprising an adhesive coupling the capping shroud to the surface of the die device other than on the protruding portion.

14. The assembly of claim 13, further comprising a second adhesive applied as one or more beads to the surface of the die device other than on the protruding portion to initially couple the capping shroud thereto.

15. A fluid ejection assembly comprising:

a fluid ejection die;

a flexible circuit having leads attached to an end of the fluid ejection die;

means for providing a capping surface for the fluid ejection die in a flush and circumscribed manner; and means for providing a seal between the fluid ejection die and the means for providing the capping surface.

16. The assembly of claim 15, further comprising a die device having a protruding portion on which the fluid ejection die is coupled.

17. The assembly of claim 16, wherein the means for providing the capping surface for the fluid ejection die substantially makes contact with the protruding portion of the die device, such that lateral movement of the means for providing the capping surface for the fluid ejection die, relative to the die, is without substantial effect.

18. The assembly of claim 16, wherein the means for providing the capping surface for the fluid ejection die is coupled to the die device at the protruding portion.

19. The assembly of claim 16, wherein the means for providing the capping surface for the fluid ejection die is coupled to the die device on a surface other than on the protruding portion.

20. The assembly of claim 19, further comprising an adhesive coupling the means for providing the capping surface for the fluid ejection die to the surface of the die device other than on the protruding portion.

21. The assembly of claim 15, wherein fluid ejection by the fluid ejection die is ink for application onto media.

22. A fluid ejection assembly comprising:

a fluid ejection die;

a flexible circuit having leads attached to an end of the fluid ejection die;

means for providing a capping surface for the fluid ejection die in a flush and circumscribed manner;

a die device having a protruding portion on which the fluid ejection die is coupled;

means for providing the capping surface for the fluid ejection die is coupled to the die device at the protruding portion; and means for providing a seal between the fluid ejection die and the means for providing the capping surface, and for coupling the means for providing the capping surface for the fluid ejection die to the protruding portion.

23. A method of assembling a fluid ejection assembly, the method comprising:

coupling a flexible circuit to an end of a fluid ejection die;

coupling the fluid ejection die to a protruding portion of a die device; and coupling a capping shroud on the die device around the fluid ejection die;

wherein coupling the capping shroud on the die device around the fluid ejection die comprises dispensing adhesive onto the die device and dispensing a sealant between the capping shroud and the fluid ejection die to provide a humidity seal between the capping shroud and the fluid ejection die.

24. The method of claim 23, wherein coupling the capping shroud on the die device around the fluid ejection die further initially comprises dispensing one or more beads of second adhesive onto the die device to initially couple the fluid ejection die to the die device.

25. The method of claim 23, wherein dispensing the adhesive onto the die device comprises dispensing the adhesive onto the protruding portion of the die device, the adhesive also serving as a humidity seal between the capping shroud and the fluid ejection die.

26. The method of claim 23, wherein dispensing the adhesive onto the die device comprises dispensing the adhesive onto a surface of the die device other than the protruding portion.

27. The method of claim 23, wherein coupling the capping shroud on the die device around the fluid ejection die further comprises curing the adhesive.

28. The method of claim 27, wherein curing the adhesive comprises curing the adhesive simultaneously with at least one of: a topside encapsulant, and a sealant.

29. The method of claim 27, wherein curing the adhesive comprises curing the adhesive non-simultaneously with at least one of: a topside encapsulant, and a sealant.

* * * * *

UNITED STATES PATENT AND TRADEMARK OFFICE

CERTIFICATE OF CORRECTION

PATENT NO. : 6,722,756 B2
DATED : April 20, 2004
INVENTOR(S) : Choy et al.

It is certified that error appears in the above-identified patent and that said Letters Patent is hereby corrected as shown below:

Column 3,
Line 54, delete "topside-ncapsulating" and insert in lieu thereof -- topside-encapsulating --;
Line 58, after "112 is" insert -- a --.

Signed and Sealed this

Tenth Day of August, 2004

JON W. DUDAS
*Acting Director of the United States Patent and Trademark Office*